US011718961B2

(12) United States Patent
Davydenko et al.

(10) Patent No.: US 11,718,961 B2
(45) Date of Patent: Aug. 8, 2023

(54) DEVICE FOR APPLYING A TREATMENT SUBSTANCE

(71) Applicant: Andritz Küsters GmbH, Krefeld (DE)

(72) Inventors: Eduard Davydenko, Grefrath-Oedt (DE); Andreas Pesch, Krefeld (DE)

(73) Assignee: Andritz Küsters GmbH, Krefeld (DE)

( * ) Notice: Subject to any disclaimer, the term of this patent is extended or adjusted under 35 U.S.C. 154(b) by 102 days.

(21) Appl. No.: 17/125,311

(22) Filed: Dec. 17, 2020

(65) Prior Publication Data

US 2021/0189660 A1 Jun. 24, 2021

(30) Foreign Application Priority Data

Dec. 23, 2019 (EP) ..... 19000589

(51) Int. Cl.

| | |
|---|---|
| ***D21H 23/56*** | (2006.01) |
| ***D21F 3/04*** | (2006.01) |
| ***D21H 19/54*** | (2006.01) |
| ***D21H 23/48*** | (2006.01) |

(52) U.S. Cl.

CPC ..... *D21H 23/56* (2013.01); *D21F 3/045* (2013.01); *D21H 19/54* (2013.01); *D21H 23/48* (2013.01)

(58) Field of Classification Search

CPC ..... D21H 23/56; D21H 19/54; D21H 23/48; D21H 19/82; D21H 19/84; D21F 3/045

See application file for complete search history.

(56) References Cited

FOREIGN PATENT DOCUMENTS

| | | | | |
|---|---|---|---|---|
| DE | 3417487 | A1 | 11/1985 | |
| DE | 4131131 | C2 | 7/1994 | |
| DE | 10012344 | A1 | 9/2001 | |
| DE | 102006057870 | A1 | 6/2008 | |
| DE | 102009012920 | A1 | 9/2010 | |
| DE | 202017100655 | U1 | 2/2017 | |
| DE | 102018100924 | A1 * | 8/2018 | ..... D21G 1/00 |
| DE | 102018100924 | A1 | 8/2018 | |
| EP | 0622127 | A1 | 11/1994 | |
| EP | 0670004 | A1 | 9/1995 | |

(Continued)

OTHER PUBLICATIONS

European Search Report dated Aug. 7, 2020 in Patent Application No. 19000589.2, 7 pages.

*Primary Examiner* — Eric Hug
*Assistant Examiner* — Matthew M Eslami
(74) *Attorney, Agent, or Firm* — Kilpatrick Townsend & Stockton

(57) ABSTRACT

Device for applying a treatment substance (2.1, 2.2), in particular starch, on at least one side of a running product web (13), in particular a paper or board web, by means of a least one curtain coater (1.1, 1.2) having a discharge nozzle (14.1, 14.2) and at least one press nip (N) following the curtain coater (1.1, 1.2) for forming a hydraulic pressure when the product web (13) passes through a press nip (N) which is formed by one of two rotating press rolls and which causes the treatment substance (2.1, 2.2) to penetrate into the product web (13), wherein the at least one press nip (N) is equipped with at least one heated applicator roll (7, 8) as a press roll to increase the penetration of the treatment substance (2.1, 2.2) into the product web (13), and at least one of the two press rolls (8) is designed with a fixed or adjustable crown (16) for the adjustment of a line load in a range of 20 to 200 kN/m.

12 Claims, 2 Drawing Sheets

(56) References Cited

FOREIGN PATENT DOCUMENTS

Figure 1:
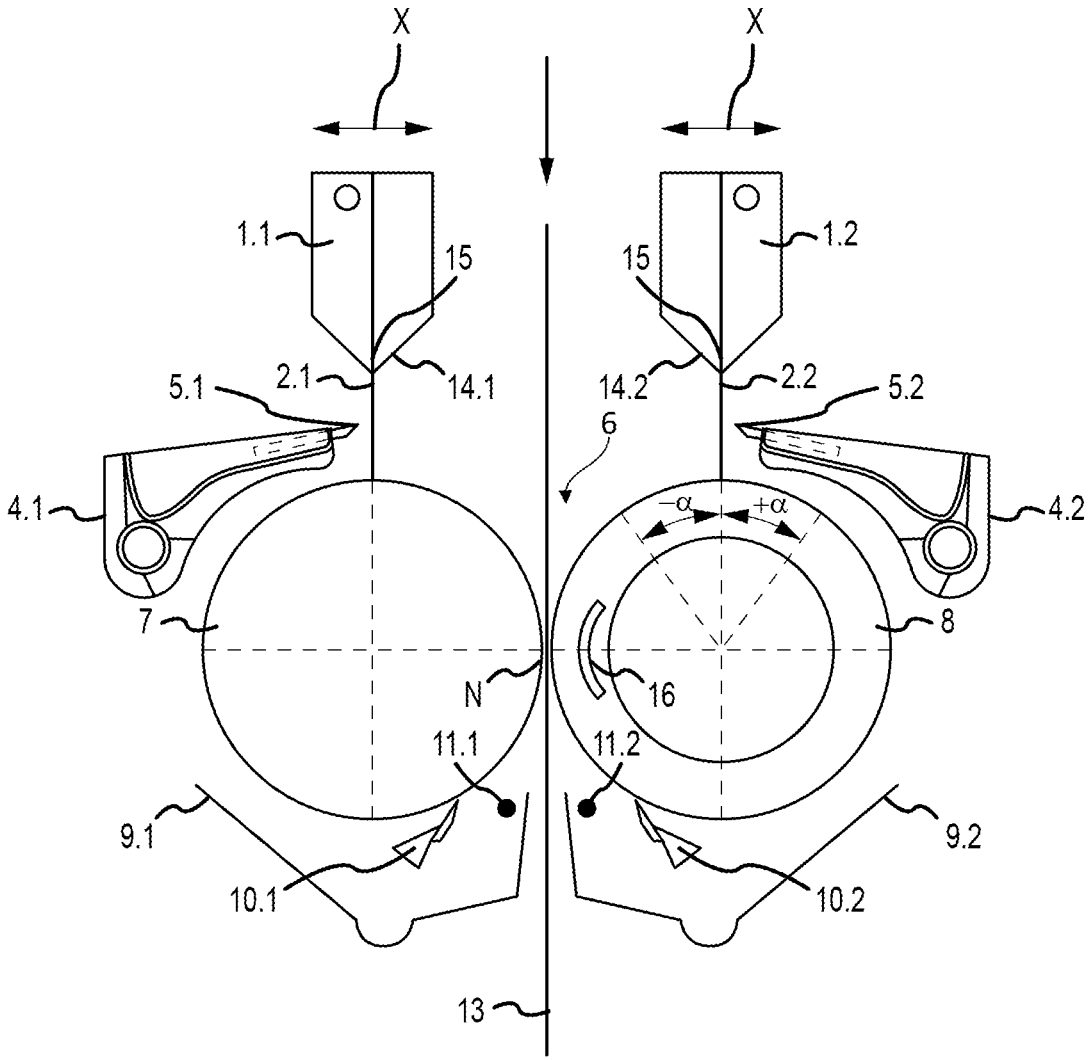

| | | | | |
|---|---|---|---|---|
| EP | 0791687 | A1 | 8/1997 | |
| EP | 0881330 | B1 | 11/2002 | |
| EP | 2090694 | A1 | 8/2009 | |
| EP | 2090694 | A1 * | 8/2009 | ..... D21G 1/00 |
| EP | 3023163 | A1 | 5/2016 | |
| EP | 3023193 | A1 | 5/2016 | |
| EP | 2646169 | B1 | 2/2017 | |
| EP | 2811069 | B1 | 8/2018 | |

* cited by examiner

DEVICE FOR APPLYING A TREATMENT SUBSTANCE

This application claims priority to EP Patent Application No. 19000589, filed Dec. 23, 2019, the disclosure of which is incorporated by reference herein in its entirety.

The invention relates to a device for applying a treatment substance to at least one side of a moving product web.

The use of a treatment substance, in particular starch, has long been a standard method to increase the resistance of the product web to moisture and also to increase its surface strength and overall strength. The treatment substance can be added directly to the pulp suspension or can be sprayed onto a wet web in the wire part of a paper machine. The treatment substance is most preferably applied after the press section and a pre-dryer section. In addition to a size press and a film press are known, in particular, liquid film coating devices for the application of a treatment substance. There is a need in the industry to provide more efficient machines for applying a treatment substance to a moving product web resulting from higher production speeds.

DE 100 12 344 A1 discloses a known device for coating one or both surfaces of a product web, using one or two liquid film coating devices which apply the treatment substance onto the surface of rolls rotating in opposite directions. These rolls form a press gap, in particular a press nip between the rolls. The product web passes the press nip. The rotation of the rolls transfers the treatment substance that is applied to the roll surfaces towards the product web and is applied onto the product web in the press nip to bring the treatment substance into close contact with the product web.

For this purpose, the product web can pass the press nip being coated with the treatment substance that is still wet. At least one of the press elements of the press nip can also be used as a transfer component, to the surface of which the treatment substance is applied and is transferred to the product web. This should ensure a good contact between product web and treatment substance.

When coating product webs using a liquid film coating device having a discharge nozzle, also known as a curtain coater, the treatment substance flows in the gravity field as a liquid film curtain to the substrate. The curtain flows in the field of gravity from the coating device to the substrate. The physical mechanisms involved in liquid film coating flows depend on an interaction of surface tension of the treatment substance and the gravity field in which the solid film moves. To control the thickness of the liquid curtain, the slot width of the discharge nozzle can be between 0.2 and about 1.5 mm.

For a targeted controlling of the layer thickness of the treatment substance applied to the substrate, both in the longitudinal direction and in the transverse direction (longitudinal profiling, transverse profiling), the slot width of the discharge nozzle is adjustable over the entire working width. It is also known that the fine controlling of the treatment quantity is important with regard to the final discharging amount of the treatment substance by the curtain applicator, i.e. 1:1 application.

It is also known that the product web in the entrainment region can be supported by an abutment, for example a counter roll or an endlessly circulating supporting belt. However, it is likewise possible that the treatment substance is applied to the product web in a free web draw, i.e. in a section of the path section of the product web in which the latter is not supported by an abutment.

It is disadvantageous that, with widths of the paper and board machines of up to, for example, 8 m, the manufacturing expenses for nozzle parts of the discharge nozzle are very high, since dimensions for the nozzle parts have to meet high precision standards, in particular when the working widths are substantially large, the associated costs are high.

Liquid film coating devices, such as a film press, are well-known and are used to apply a liquid film to the paper that is ready-metered. The supply of the application and coating quantities is carried out via nozzles or roll application systems as it is known from a coating section. The name "film press" is usually used as a generic term, known solutions cover as well the Speedsizer and the Metering Blade Size Press.

Film presses are known, for example from DE 34 17 487 A1 and DE 41 31 131 C2, where starch, sizing suspension or coating colour is applied to an applicator roll using a dosing applicator and is metered by means of a metering blade. The paper or board web is coated on both sides in a press nip between the applicator rolls.

When starch is applied, the temperature of the starch is usually between 50° C. and 80° C. The typical solids content of the starch is between 8% and 15% with an application weight of 0.5 to 6 g/m$^2$ per side. In certain cases, a film press can also be used to apply the starch to the paper or board web with a solids content of up to 15%. For a pigment coating, the solid fraction is composed of a starch portion and a pigment portion which are usually in a range between 15% and 40%. The line load between the applicator rolls is usually between 40 and 70 kN/m.

When coating the paper web, the starch should be applied to the paper web as uniformly as possible. The application quantity must be as constant as possible over the entire working width. In film presses, the volume flow in the application zone is divided into two partial streams. One part of the starch flows with the applicator roll to the metering blade and is used for the paper coating. Via the overflow gap another part of the starch flows back against the running direction of the applicator roll into a collecting tank for a re-use. The overflow gap between the bar of the applicator chamber and the applicator roll has a significant impact on the uniformity of the distribution of the starch over the working width.

A disadvantage of this construction is that the overflow gap induces an expansion in particular in the middle area of the paper web. This leads to higher volume flows in the middle area and therefore to a non-uniform distribution of the starch over the working width. To compensate for this, the overflow quantity of the starch must be kept very high. Depending on the speed of the paper web, the overflow quantity of the starch is 10 to 30 times higher than the application quantity which is required for a coating of the web. Due to the high pump power, these film presses have a high energy consumption and poor economic efficiency resulting therefrom.

To improve economic efficiency of film presses of this type, film presses with a perforated blade (sealing blade) have been developed. The perforated blade is arranged on the applicator roll as an acute or set-against blade. These film presses are known, for example from EP 2 646 169 B1 and EP 3023 163 A1 and EP 3 023 193 A1. The overflow quantity of the starch flows uniformly over the working width through holes or slots in the blade into a collecting tank. Although this solution can reduce the overflow quantity of the starch by 10% to 20%, a continuous flow of starch out of the application zone is, however, still necessary in order to avoid the risk of air inclusions in the application zone. Therefore, the economic efficiency is not particularly good here either.

To reduce the quantity of the circulating flow of starch in film presses, the application chamber has been replaced by spray nozzles. The starch is pre-metered via free-jet nozzles. The starch is sprayed onto the applicator roll as a thin film. The following levelling can be carried out via a conventional doctor blade, as known, for example, from EP 0 881 330 B1. Film presses having free-jet nozzles but no doctor blade are as well-known and disclosed, for example, in EP 0 670 004 B1 and DE 20 2017 100 655 U1.

The free-jet nozzles permit a very thin film application to the applicator roll. As a result, the recirculated quantity of starch is reduced to a minimum. The film presses with the spray nozzles have the big disadvantage that the maximum solids content of the starch is limited to about 14%. In particular with high solids contents of the starch, particulate matter of the starch adhere to the free-jet nozzles. This leads to streaking and resultant uneven distribution of the starch across the web width. In the worst case, this can lead to blockages in the nozzles and to interruptions in production. A further disadvantage is the formation of a mist of starch particles in the application zone. This causes build-up of small starch particles on the entire surface of the film press. This increases the cleaning effort and increases the risk of deposits that can affect the paper web. An additional technical effort is required to extract the mist from the application zone, which in turn causes additional problems with a fluttering paper web. To stabilize the web, an air stream can be supplied to the application zone, as described, for example, in EP 2 811 069 B1.

A further disadvantage of the spray nozzles is the cooling of the atomized starch particles in the air stream in the area of the application zone. Lowering the temperature leads to a reducing of the starch penetration into the paper due to an increased viscosity. To act against the cooling of the starch, steam is guided to the application zone to heat the starch particles. The technical outlay in this solution is very high.

Also known is a coating system for multi-layer application, as described, for example, in DE 10 2006 057 870 A1. The starch is applied to the applicator rolls in multiple layers one on top of the other by means of curtain applicators and then transferred jointly to the product web in a nip.

From DE 10 2018 100 924 A1, it is known to apply starch to a moving fibrous web, where the web goes through a treatment press nip defined by a first and a second roll, the web being coated with a still wet starch application at that time. At least one of the two rolls, preferably both rolls, has/have a hardness of 15 P&J (Pusey & Jones) or less. Still harder rolls of 5 P&J or less, at most 1 P&J or less, can be used. The load in the treatment press nip is set between 30 kN/m and 140 kN/m. The use of one or as well two rolls having a quite high hardness allows to transfer the starch to the fibrous web in a treatment nip more efficiently.

The term hardness of a roll is understood to be the hardness of the outer layer or of the outer covering of the roll. The hardness according to P&J is a common measure for rolls. It can be determined using commercially available devices, such as the Zwick 3108 P&J hardness testing device, which meets the requirements of the ASTM D531-89 standard.

However, the disadvantage here is that the solids content for starch penetration is only up to about 25%, which considerably reduces the efficiency of the system.

It is an object of the invention to provide a device which permits an economically more efficient application of an application medium, in particular starch, to a running product web when the product web is guided through a treatment press nip after the application of the starch in a paper machine or a paper machine section.

This object is achieved by the features of claim 1.

Herewith a device is provided that is technologically and economically more efficient by increasing the penetration of the treatment substance, in particular starch as an application medium. An increase in the strength properties of the paper or the board can be achieved.

According to the invention a curtain coater is used, applying very high solids contents of treatment substance, in particular starch. Solids contents of up to 40%, preferably 15% to 35%, can be applied in one or more layers. The treatment substance is transferred indirectly to the product web via a heated transfer element.

In order to enable high penetration of the treatment substance having high solids content into the product web, exact control of the line load distribution over the roll width is provided. For this purpose the press nip has at least one roll with a fixed or adjustable crown, in particular a controlled deflection roll. Line loads in the press nip between 20 kN/m and 200 kN/m preferably 80 kN/m and 120 kN/m can then be varied over the entire pressing force range, since exact thickness cross profile control/regulation is possible independent of the line load level. The same also applies to the temperature of a heated roll so that, according to the invention, it is intended to design at least one applicator roll as a heated roll. The temperature of the heated roll is preferably controlled in the range of 50° C. to 150° C., preferably in the range of 90° C. to 120° C.

If a treatment substance is to be applied on both sides, the press nip can be formed by two applicator rolls, which can both be designed as heated rolls. The applicator rolls are preferably hard rolls with a hardness of less than 30 P&J (Pusey & Jones).

Increased efficiency of the device then results in particular from a significantly reduced energy consumption for the evaporation of the excess water when high concentration of the treatment substance is applied.

In addition, it is thanks to the inventors to have recognized that lower accuracies of the slot widths of the outlet slot of the nozzle of a liquid film coating device, in particular a curtain coater, are compensated over the working width via a sump 6 which is formed at the press nip or immediately before the press nip as a result of the method, in particular when precise adjustment of the line load profile transverse with respect to the web or along the press nip is possible. If parallelism of the roll contact surfaces is ensured across the web, for example using a controlled deflection roll as applicator roll, a compensation sump 6 is formed in the feed zone of the press nip.

The high manufacturing tolerance that is usually required in the field of liquid film coating devices, in particular for curtain coaters, is therefore not necessary according to the invention and can be made more open. This reduces the manufacturing effort of the discharge nozzles and the investment costs. The accuracy of the outlet slot of the discharge nozzle of the curtain coater is preferably in the range of ±2.5 μm to ±10 μm, particularly preferably at ±4 μm to ±8 μm/. This applies in particular to usual slot widths in the range of 0.2 to 1.5 mm.

Further advantages and features of the invention can be learned from the following description and the dependent claims.

The invention is explained in more detail below using the exemplary embodiments shown in the appended figures.

Figure 2:
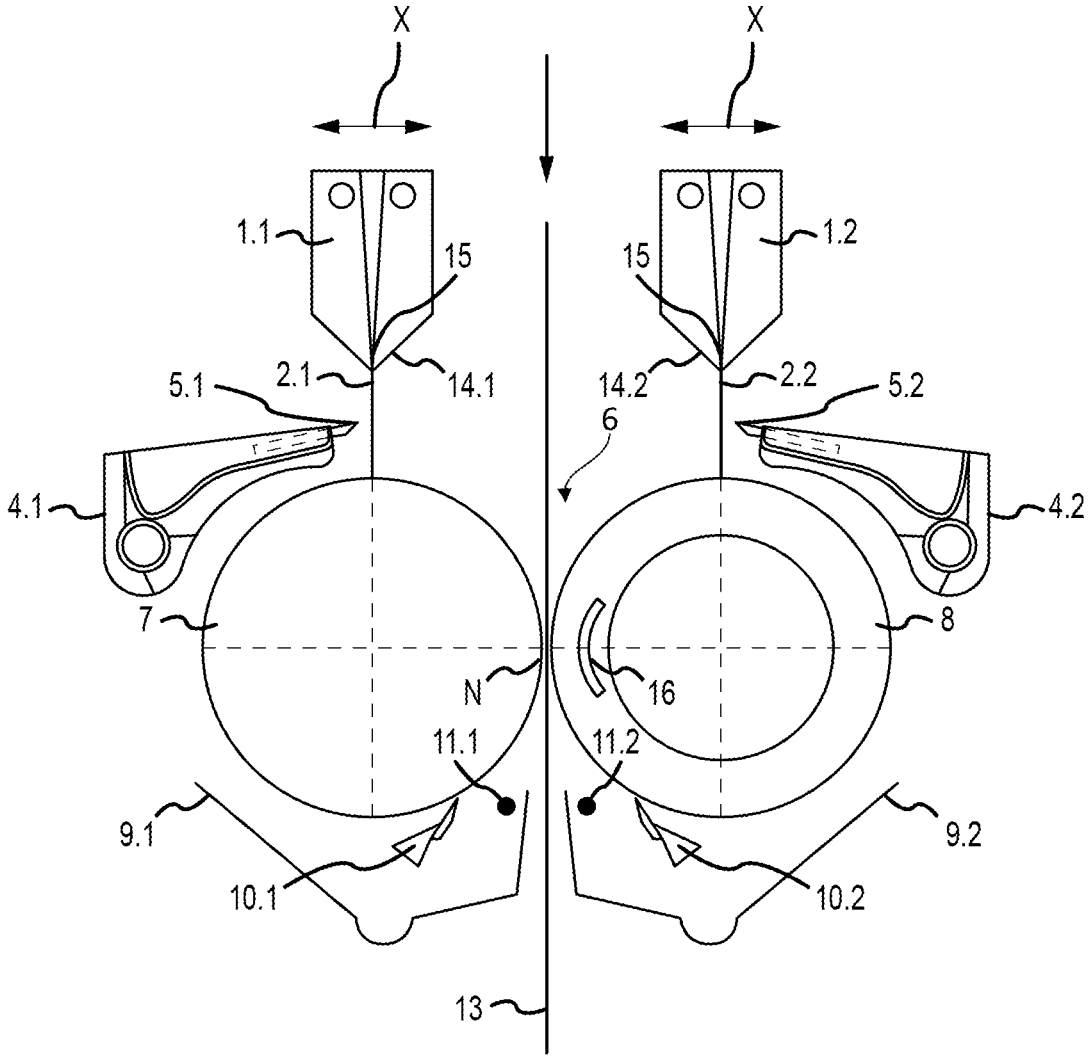

FIG. 1 schematically shows a device including liquid film coating devices and discharge nozzles according to a first exemplary embodiment, FIG. 2 schematically shows a device including liquid film coating devices and discharge nozzles according to a second exemplary embodiment.

As FIG. 1 shows, the invention relates to a device for the indirect application of a treatment substance 2.1, 2.2, in particular starch, on at least one side of a running product web 13, in particular a paper or board web, by means of at least one curtain coater 1.1, 1.2 having a discharge nozzle 14.1, 14.2. The at least one curtain coater 1.1, 1.2 is followed by a press nip N for forming a hydraulic pressure when the product web 13 passes through the press nip N, which causes the treatment substance 2.1, 2.2 to penetrate into the product web 13. The press nip N is preferably a hard nip, which is formed by two hard rolls, the applicator rolls 7, 8.

The at least one curtain coater 1.1, 1.2 is designed to discharge a treatment substance 2.1, 2.2 having a solids content in at least one layer of between 10% and 40%. To increase the penetration of the treatment substance 2.1, 2.2 into the product web 13, the at least one press nip N is equipped with at least one heated applicator roll 7, and the heated applicator roll 7 and/or a counter element is designed as an applicator roll 8 having a fixed or an adjustable crown 16.

The curtain coater 1.1, 1.2 has a discharge nozzle 14.1, 14.2 having an outlet slot 15 which has an accuracy in the range of ±2.5 μm to ±10 μm in the slot length with a slot width of preferably 0.2 to 1.5 mm.

As shown by the arrows X, the distance of each curtain coater 1.1, 1.2 to the press nip N is adjustable for an arrangement for indirect application of the treatment substance 2.1, 2.2 with a selectable dwell time of the heat transfer from the at least one heated applicator roll 7 to the treatment substance 2.1, 2.2 and/or the product web 13, as will be explained below.

The applicator roll 8 with adjustable crown 16 is preferably a controlled deflection roll. Preferably, both applicator rolls 7, 8 of the press nip N are also designed as heated rolls. The applicator rolls 7, 8 of the press nip N preferably have coatings with less than 30 P&J. Furthermore, the applicator rolls 7, 8 of the press nip N are designed for a roll surface temperature of 50° C. to 150° C., preferably 100° to 120° C. The line load can be selected in the range of 20 kN/m to 200 kN/m An angle α for a contact point of the curtain of the treatment substance 2.1, 2.2 on an applicator roll 7, 8 of the press nip N is preferably between −90° and +45°. Furthermore, the respective curtain coater 1.1, 1.2 is designed to control the solids content of the treatment substance 2.1, 2.2 in at least one layer of 25% to 55%.

The application weight of the treatment substance per side can be 0.5 to 6 g/m$^2$ and the temperature of the treatment substance, in particular the starch, can be in the range of 55° to 99° C. before it is applied to an applicator roll 7, 8. Furthermore, the viscosity of the treatment substance can be significantly higher than that in film presses, namely 20 to 500 mPa s (Brookfield 100 rpm). The specific volume flow from the nozzle of the curtain coater 1.1, 1.2 is in the range of 4 l/(min×m) to 30 l/(min×m). A film of the treatment substance 2.1, 2.2, in particular starch, in the range of 5 ml/m$^2$ to 100 ml/m$^2$ is preferably applied to the respective applicator roll 7, 8.

Finally, guide rolls 12 can also be provided which determine a treatment path of the running product web 13 between curtain coater 1.1, 1.2 and press nip N.

According to FIG. 1, for a one-sided and, for example, single-layer application, the treatment substance 2.1, in particular starch, is firstly applied by a curtain coater 1.1 to a rotating applicator roll 7. For a two-sided application, a further, for example single-layer treatment substance (film) 2.2 is applied to a second rotating applicator roll 8 using a second curtain coater 1.2. The dwell time of the treatment substance 2.1, 2.2 on the respective applicator roll 7, 8 until it enters the press nip N can be selected individually for each side and can therefore also be selected differently. The position of the respective curtain coater 1.1, 1.2 with respect to the associated applicator rolls 7, 8 can be changed in the direction of the arrow X for this purpose by means, for example, of horizontal and possibly additional vertical displacement.

A specific length of the outer roll circumference defines a dwell time, so that the time between the curtain contact and its entry into the press nip N can be set, thus increasing or decreasing the dwell time, as indicated by the angle α. If the applicator roll 7, 8 is heated, the dwell time can be used to influence an increase in temperature of the treatment substance 2.1, 2.2 before it enters the press nip N. The treatment substance 2.1, 2.2 can then be thermally pre-treated and pressed into the product web 1 on both sides in the press nip N between the applicator rolls 7, 8.

In a known manner, a starter trough 4.1, 4.2 with quick-start equipment 5.1, 5.2. can be assigned to each curtain coater 1.1, 1.2. The same applies to the provision of collecting troughs 9.1, 9.2, doctors 10.1, 10.2 and spray-water nozzles or steam nozzles 11.1, 11.2 for cleaning of the applicator rolls 7, 8. The diameter of the applicator rolls 7, 8 can be, 400 to 1800 mm, for example. Instead of heated applicator rolls 7, 8, heated transfer belts can also be used.

According to FIG. 2, a multilayer curtain coater 1.1, 1.2 is provided respectively. Two-layered liquid film coating is used for example. Both curtain coaters 1.1, 1.2 can also be designed differently as multi-layered. When a two-layered design is used, starch for penetrating into the product web can be applied as an inner layer, for example. The outer (second) layer can be, for example, a pigment coating. The solids content of the starch in the 1$^{st}$ layer can be, for example, 6% to 50%, preferably 15% to 35%. The solids content of the coating colour in the 2$^{nd}$ layer can be in the range of 20% and 68%. Alternatively, the respective, for example two-layered, curtain can consist of two starch layers. The 1$^{st}$ layer can have a lower concentration of starch, in order to achieve higher penetration for high delamination strength. A 2$^{nd}$ layer with a higher starch concentration increases the modulus of elasticity of the outer layers close to the surface and therefore achieves a higher bending stiffness.

This results in great technological advantages, and a high economic efficiency of the system results from the considerably reduced energy consumption for the evaporation of excess water with a high starch concentration. With the same strength it is possible to save raw materials by reducing the quantity of fibre in the paper or board.

In all other respects, the above explanations relating to FIG. 1 apply accordingly.

The invention now being folly described, it will be apparent to one of ordinary skill in the art that many changes and modifications can be made thereto without departing from the spirit or scope of the appended claims.

The invention claimed is:

1. Device for applying indirectly a treatment substance, the treatment substance including:

starch, on at least one side of a running product web, the running product web including at least one of a paper or board web, by means of at least one curtain coater having a discharge nozzle;

at least one press nip for forming a hydraulic pressure when the product web passes through a press nip which is formed by one of two rotating press rolls and which causes the treatment substance to penetrate into the product web, wherein the at least one curtain coater has a discharge nozzle having an outlet slot with a manufacturing tolerance in a range of ±2.5 μm to ±10 μm in slot length with a slot width of 0.2 to 2.0 mm and the at least one press nip is equipped with at least one heated applicator roll as a press roll to increase the penetration of the treatment substance into the product web, and at least one of the two press rolls includes a crown for adjusting of a line load in a range of 20 to 200 kN/m to increase the range of manufacturing tolerances of the discharge nozzle; and a sump being formed at, or immediately in front of, the press nip when the line load is in the range of 20 to 200 kN/m, wherein the sump is formed at a feed area of the press nip where a parallelism of roll contact surfaces is achieved by compensating for a deflection of the rolls due to the line load.

2. Device according to claim 1, wherein the press nip is a hard nip.

3. Device according to claim 1, wherein a distance of the respective curtain coater with respect to the press nip is adjustable for an arrangement for an indirect application of the treatment substance with a selectable dwell time for a transfer of heat from the least one heated applicator roll to the treatment substance.

4. Device according to claim 1, wherein the curtain coater is configured to apply a multi-layer curtain.

5. Device according to claim 1, wherein the press roll with adjustable crown is a controlled deflection roll.

6. Device according to claim 1, wherein both press rolls of the press nip are heated applicator rolls.

7. Device according to claim 1, wherein the applicator rolls of the press nip have coatings with less than a hardness of 30 P&J.

8. Device according to claim 1, wherein the press rolls of the press nip are applicator rolls for a roll surface temperature of 50° C. to 150° C.

9. Device according to claim 1, wherein the press nip is configured to accommodate line loads in the range of 20 kN/m to 200 kN/m.

10. Device according to claim 1, wherein an angle $\alpha$ for a contact point of the curtain of the treatment substance on an applicator roll of the press nip is between −90° and +45°.

11. Device according to claim 1, wherein the at least one curtain coater is configured to control a solids content of the treatment substance in at least one layer of 25% to 55%.

12. Device according to claim 1, wherein the crown is fixed or adjustable.

* * * * *